US011008154B2

(12) United States Patent
Polak

(10) Patent No.: US 11,008,154 B2
(45) Date of Patent: May 18, 2021

(54) INSULATING BOTTLE COVER

(71) Applicant: Henderson Aquatics, Inc., Millville, NJ (US)

(72) Inventor: Joseph P. Polak, Cape May Court House, NJ (US)

(73) Assignee: Henderson Aquatics, Inc., Millville, NJ (US)

( * ) Notice: Subject to any disclaimer, the term of this patent is extended or adjusted under 35 U.S.C. 154(b) by 77 days.

(21) Appl. No.: 16/412,925

(22) Filed: May 15, 2019

(65) Prior Publication Data

US 2020/0361696 A1 Nov. 19, 2020

(51) Int. Cl.
*B65D 81/38* (2006.01)
*B65D 23/08* (2006.01)

(52) U.S. Cl.
CPC ..... *B65D 81/3876* (2013.01); *B65D 23/0842* (2013.01)

(58) Field of Classification Search
CPC ..... A45F 2003/166; A45F 2200/0566; A45F 2200/0583; A45F 3/16; A45F 2005/006; A45F 2005/008; A45F 3/005; A47G 23/0241; A47G 23/02; A47G 23/03; A47G 23/0316; B65D 23/00; B65D 23/0842; B65D 23/0871; B65D 23/0892; B65D 1/0223; B65D 81/3876; B65D 81/3888; B65D 81/389; B65D 81/3879; A47F 1/04; F25D 31/007; F25D 2331/803; A45C 11/20
See application file for complete search history.

(56) References Cited

U.S. PATENT DOCUMENTS

| | | | | |
|---|---|---|---|---|
| 4,540,611 A * | 9/1985 | Henderson | B65D 23/08 150/901 |
| D302,509 S * | 8/1989 | Byrns | D7/608 |
| 6,059,140 A * | 5/2000 | Hicks | B65D 81/3879 220/6 |
| 6,550,271 B2 | 4/2003 | Silbert | |
| D524,157 S * | 7/2006 | Bolden | D7/607 |
| D589,758 S * | 4/2009 | Mancha | D7/607 |
| D610,411 S * | 2/2010 | Holladay | D7/624.2 |
| D614,451 S * | 4/2010 | Jensen | D7/624.2 |

(Continued)

FOREIGN PATENT DOCUMENTS

CA 2543944 A1 * 12/2006 ..... B65D 81/3888

OTHER PUBLICATIONS

Four photographs of an insulated bottle cover with zipper in neck portion and bottom web between opposite openings.

*Primary Examiner* — J. Gregory Pickett
*Assistant Examiner* — Abigail Elizabeth Guidry
(74) *Attorney, Agent, or Firm* — Howson & Howson LLP

(57) ABSTRACT

An insulating cover for beverage bottles is formed by cutting, folding, and sewing a unitary, flexible sheet of insulating material such as a laminate of fabric and neoprene foam. Following sewing, the cover is turned inside out so that the stitching is hidden inside the cover. The sheet is shaped in the cutting stage so that the cover includes a portion that surrounds a part of the neck of the bottle, and a web that extends across and covers substantially the entire bottom surface of the bottle. The bottle is inserted into the cover through one of two openings on opposite sides of the web.

5 Claims, 2 Drawing Sheets

(56) References Cited

U.S. PATENT DOCUMENTS

| | | | | |
|---|---|---|---|---|
| 7,850,036 | B2 * | 12/2010 | Cirone | F41B 11/62 220/581 |
| D666,060 | S * | 8/2012 | Welch | D7/606 |
| D796,270 | S * | 9/2017 | McConnell | D7/625 |
| D858,211 | S * | 9/2019 | Meno | D7/607 |
| D864,671 | S * | 10/2019 | Meno | D7/607 |
| 2006/0091143 | A1 * | 5/2006 | Chantalat | B65D 81/3879 220/737 |
| 2007/0017924 | A1 * | 1/2007 | Hundley | B65D 81/3876 220/737 |
| 2009/0050636 | A1 * | 2/2009 | Sanchez | B65D 81/3876 220/592.24 |
| 2014/0353324 | A1 * | 12/2014 | Crain | B65D 81/3876 220/737 |
| 2016/0095457 | A1 * | 4/2016 | Deakin | A45C 15/00 206/38 |
| 2016/0106247 | A1 * | 4/2016 | Gardner | A47G 23/0241 220/560 |
| 2019/0135523 | A1 * | 5/2019 | Gabriel | A47G 19/2288 |
| 2019/0168947 | A1 * | 6/2019 | Luchak | B65D 81/3879 |

* cited by examiner

INSULATING BOTTLE COVER

FIELD OF THE INVENTION

This invention relates to improvements in insulating covers for beverage containers, and particularly to an improved insulating cover for use with a bottle containing a cooled beverage such as beer in order to reduce the rate at which the beverage is warmed by ambient heat, by heat transmitted from a surface on which the bottle rests, or by heat conducted from an individual's hand.

BACKGROUND OF THE INVENTION

Insulating covers for use with beer cans are well known. A typical beer can cover is composed of a laminate of fabric and an insulating foam such as neoprene, formed into a shape that includes a hollow cylindrical part that receives and closely fits all, or at least a lower portion of, the cylindrical part of the beer can, an open top through which the beer can is inserted into the hollow cylindrical part, and a bottom, which can be entirely closed, or which can have a central opening or one or more openings.

Insulating covers for bottles such as beer bottles are formed from materials similar to the materials used for beer can covers. Because a typical beer bottle has a neck that is narrower than the lower part of the bottle, the insulating bottle cover is typically formed in one of two ways. It can have a shape similar to that of the beer can cover, i.e., an open top having a shape and size corresponding to the shape and size of a horizontal cross section of the interior of the cover. An example of a first kind of insulating bottle cover is illustrated and described in U.S. Design Pat. No. D795,025, granted Aug. 22, 2017. This type of cover does not insulate the neck portion of a bottle. A second kind of insulating bottle cover includes a portion fitting the neck of the bottle, but requires a zipper or similar closure device to enable the cover to be fitted onto and removed from, the bottle. Examples of bottle covers having zippered neck-fitting portions are illustrated and described in U.S. Design Pat. No. D666,060, granted Aug. 28, 2012 and in U.S. Pat. No. 6,550,271, granted Apr. 22, 2003.

Both of the above types of bottle covers are closed by insulating material at the bottom in order to limit conduction of heat to the contents of the bottle from a surface on which the bottle is placed.

SUMMARY OF THE INVENTION

This invention provides a insulating bottle cover having a neck-fitting portion that does not require a zipper or similar closure device. The bottle cover is simple, inexpensive, decorative, easily manufactured, and easy to use, and provides effective thermal insulation.

The insulating bottle cover in accordance with the invention comprises a flexible sheet of insulating material formed in such a way that it has a hollow, substantially cylindrical portion for fitting a body of a beverage bottle, and a neck portion for fitting the neck of the bottle. The cylindrical portion is substantially uniformly spaced from a central axis. The neck portion extends in the direction of the central axis from the cylindrical portion and has an end opening remote from the cylindrical portion. The neck portion is tapered and its end opening has a maximum dimension transverse to the central axis smaller than the internal diameter of the cylindrical portion. A web portion extends from a first part of an end of the cylindrical portion remote from the neck portion to a second part thereof opposite from the first part. The cover has a bottle-insertion opening at least on one side of the web. The bottle-insertion opening is stretchable to a size sufficient to allow passage of the body of a beverage bottle having a diameter at least as great as the internal diameter of the substantially cylindrical portion.

Preferably, both the cylindrical portion and the neck portion have a permanently continuous perimeter.

In a preferred embodiment, the cover is formed from a unitary sheet of insulating material and has first and second seams, each extending from the end opening of the neck portion to the end of the cylindrical portion remote from the neck portion. These first and second seams are preferably on diametrically opposite sides of the insulating cover. In the preferred embodiment each of the seams is composed of stitches passing through overlapping portions of the flexible sheet located on the interior of the insulating cover.

The width of the web portion, measured in a plane to which said central axis is perpendicular, increases proceeding from locations at which it meets the first and second parts of the cylindrical portion toward an intermediate location between the locations at which it meets the first and second parts of the cylindrical portion.

DETAILED DESCRIPTION OF THE PREFERRED EMBODIMENTS

The sheet from which the bottle cover of the invention is formed can be composed of any of a variety of flexible thermal insulating materials. Known materials used for conventional insulating bottle and can covers can be used. One such material is a laminate of fabric and an insulating foam such as neoprene.

Figure 1:
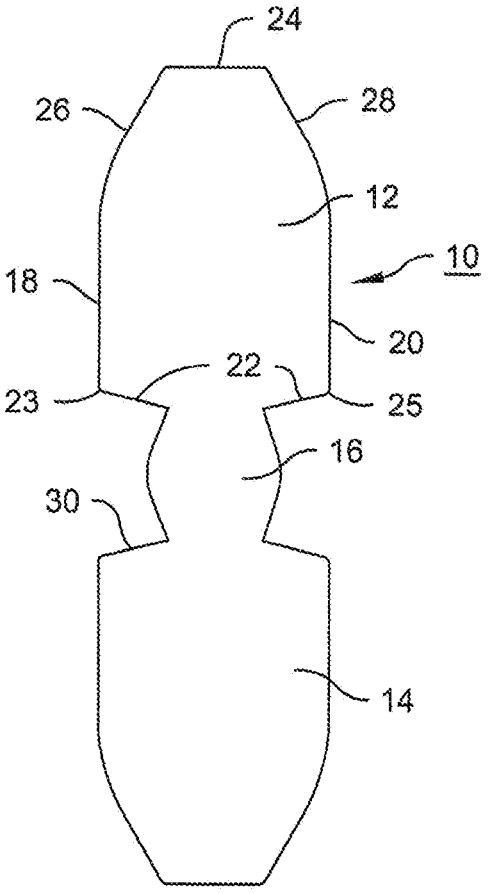
FIG. 1 is an elevational view of a flexible sheet of insulating material used to form the insulating cover, showing the shape of the sheet when in a flat condition.

The sheet of insulating material is first cut to a shape corresponding to that shown in FIG. 1. The cut sheet 10 is composed of two identical parts 12 and 14 and a web connecting part 14 to part 12. Part 12 is formed with parallel opposite side edges 18 and 20, and an end edge 22 which extends from a corner 23 to a corner 25. End edge 22 is met by one end of the web 16. The side edges 18 and 20 extend respectively from corners 23 and 25 of the end edge 22 to intermediate locations between edge 22 and an opposite end edge 24. Opposed edge portions 26 and 28 converge, and extend respectively from the intermediate locations to end edge 24, the length of which is less than the distance between the parallel side edges 18 and 20. Part 14 has a shape identical to that of part 12 and extends in the opposite direction from the end of web 16 opposite the end of the web from which part 12 extends.

As seen in FIG. 1, the web 16 bulges, i.e., its width increases proceeding from the locations at which it meets edge 22 of part 12, and the corresponding edge 30 of part 14, toward an intermediate location between locations at which it meets edges 22 and 30.

Figure 2:
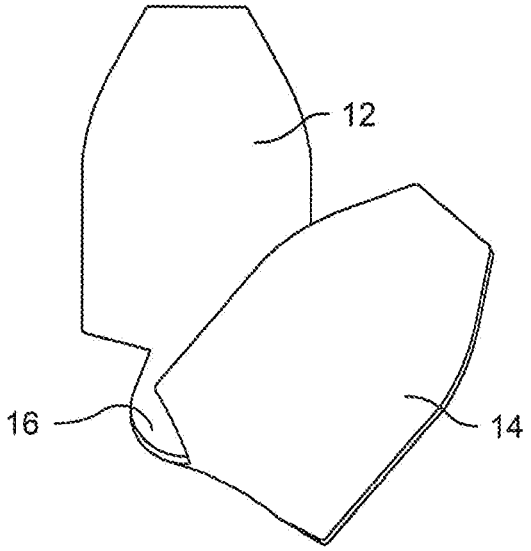
FIG. 2 is an elevational view showing the flexible sheet partially folded, in a second stage of the process of forming the insulating cover.
Figure 3:
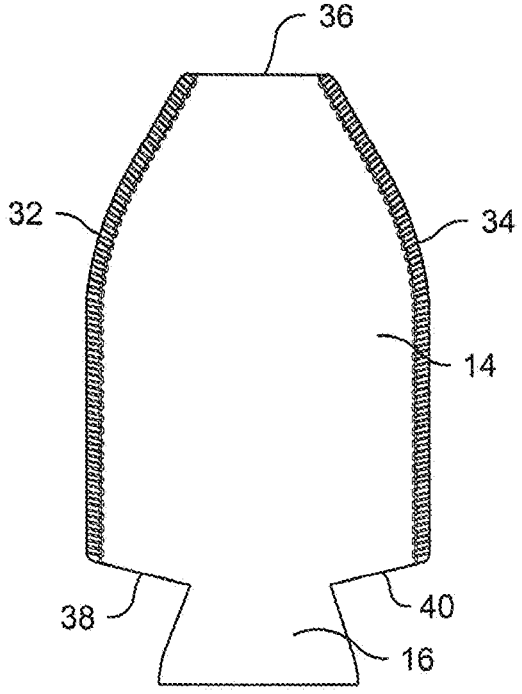
FIG. 3 is an elevational view showing the stitching forming seams on opposite sides of the folded sheet in a third stage of the forming process.

After the sheet is cut to the shape illustrated in FIG. 1, the sheet is folded at web 16 so that part 14 is brought toward part 12, as shown in FIG. 2, and parts 12 and 14 are then brought into overlying relationship, with the parallel side edges 18 and 20 of part 12 positioned alongside the respective corresponding side edges of part 14, and with the converging edges 26 and 28 of part 12 similarly positioned along the respective corresponding converging edges of part 14. The configuration of the folded sheet is then as shown in FIG. 3. The overlying edges of parts 12 and 14 are then sewn together using a stitch such as an overlock stitch as depicted in U.S. Pat. No. 4,628,849, granted on Dec. 16, 1986, or another suitable form of stitch such as a cover stitch or a single needle stitch. A continuous seam 32 extends along side edge 18 and converging edge 26 of part 12 and the corresponding overlying side edge and converging edge of part 14. An opposite continuous seam 34 extends along side edge 20 and converging edge 28 of part 12 and the corresponding overlying side edge and converging edge of part 14.

There is no stitching along end edge 24 of part 12 and the overlying end edge of part 14, nor is there stitching along the overlying edges 22 and 30 or on the connecting web 16. Thus, an opening 36 is provided at one end of the structure shown in FIG. 3, and openings 38 and 40 are provided at the opposite end of the structure on opposite sides of the web 16.

Figure 4:
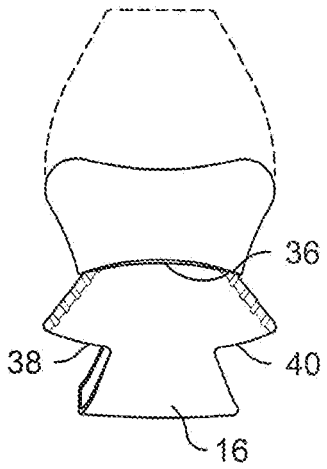
FIG. 4 is an elevational view showing the cover being turned inside-out in a fourth stage of the forming process.
Figure 5:
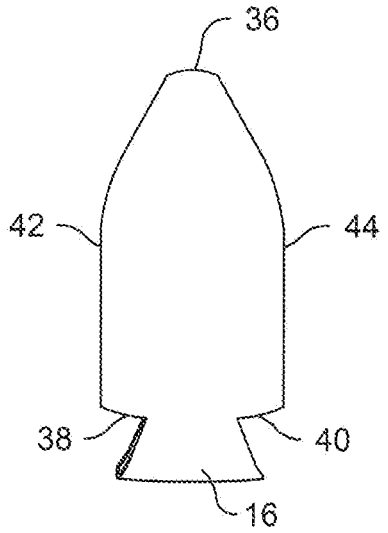
FIG. 5 is an elevational view showing the completed cover.

The cover is then turned inside-out so that the stitching is located inside the cover and hidden from view. The cover can be turned inside-out by stretching the opening 36 and pulling the cover through opening 36 as shown in FIG. 4, or alternatively by pulling the cover through one of openings 38 and 40. In the completed cover, as shown in FIG. 5, the stitching is hidden from view. Only seam lines, 42 and 44, are visible from the outside.

Figure 6:
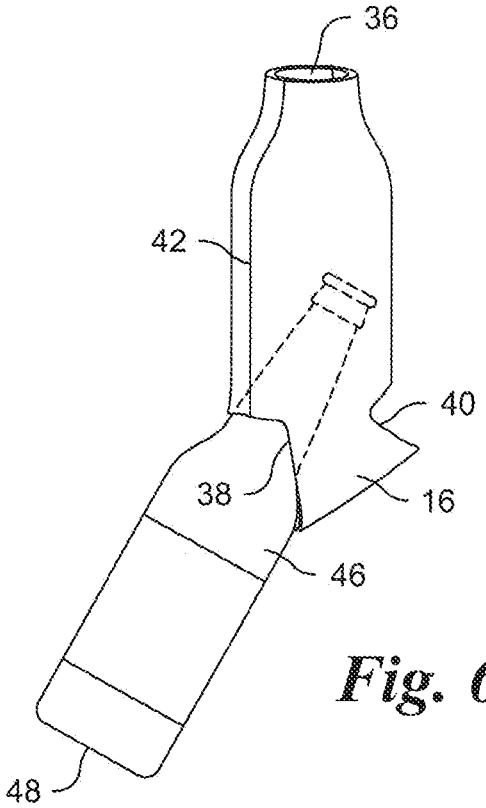
FIG. 6 is an elevational view illustrating the manner in which a bottle is inserted into the insulating cover through one of two stretchable bottle-insertion openings formed between the web portion and the end of the cylindrical portion of the cover remote from the neck portion.
Figure 7:
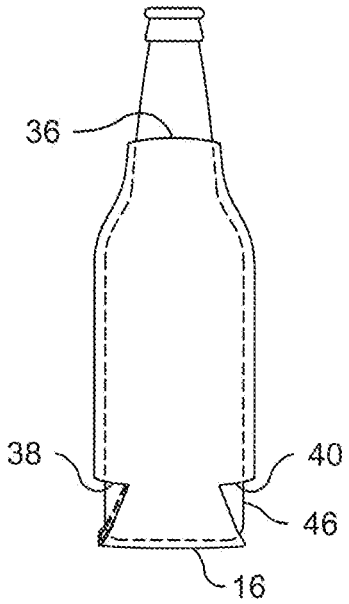
FIG. 7 is an elevational view showing the insulating cover fully engaged with a bottle.

As shown in FIG. 6, the cover can be fitted onto a beer bottle 46 by inserting the neck of the bottle through one of openings 38 and 40, and pulling the cover over the bottle until, as shown in FIG. 7, the neck of the bottle extends though opening 36, and the web 16 extends across the bottom of the bottle. The bulging shape of the web facilitates expansion of opening 38 or opening 40 for insertion of the bottle, while providing coverage of substantially the entire bottom surface 48 of the bottle for stability when the bottle is placed on a table or other horizontal surface.

The cover according to the invention is usable with beer bottles and soft-drink bottles, and larger scale versions can be made with appropriate proportions to fit other bottles such as 0.75 and 1.5 liter bottles.

The cover provides effective insulation by covering all of the bottle except for a portion of the neck extending beyond opening 36, and the two areas adjacent the bottom of the bottle exposed through openings 38 and 40. It is easily fitted onto a bottle, and can be readily removed and re-used. Furthermore, because it does not require a zipper, it can be manufactured inexpensively.

What is claimed is:

1. An insulating cover for a beverage bottle having a cylindrical portion with a predetermined diameter and a neck portion, the insulating cover comprising a flexible sheet of insulating material and having a hollow, cylindrical portion for fitting said cylindrical portion of said beverage bottle, said cylindrical portion of said insulating cover being capable of being flexed to a circular cylindrical condition in which said cylindrical portion of said insulating cover is uniformly spaced from a central axis and has an internal diameter equal to the diameter of said cylindrical portion of said beverage bottle, the insulating cover also having a neck-fitting portion for fitting a portion of the neck of said beverage bottle, said neck-fitting portion being continuous with said cylindrical portion of the insulating cover, having a permanently continuous perimeter, and extending in the direction of said central axis from said cylindrical portion of said insulating cover, said neck-fitting portion being tapered and having first and second opposite ends, said first end of the neck-fitting portion meeting, and being continuous with, said cylindrical portion of said flexible sheet, and said second end of the neck-fitting portion having an opening through which the neck of said beverage bottle can extend, said opening being smaller than said internal diameter of the insulating cover, said neck-fitting portion having dimensions such that an openable closure device would be required on said neck-fitting portion in order for the insulating cover to be fitted onto, and removed from, said beverage bottle by moving said beverage bottle through said neck-fitting portion, said cylindrical portion of said insulating cover having a first end meeting said first end of said neck-fitting portion, and a second end remote from said first end of said neck-fitting portion and spaced from said first end of said cylindrical portion of said insulating cover along the direction of said central axis, and a web portion extending from a first part of said second end of the cylindrical portion to a second part thereof opposite from said first part, and meeting each of said first and second parts in a permanently continuous relationship, the insulating cover also having a bottle-insertion opening at least on one side of said web portion, said bottle-insertion opening being stretchable to the size of said cylindrical portion of the insulating cover when said cylindrical portion of the insulating cover is in said circular cylindrical condition, whereby said cylindrical portion of said beverage bottle can pass through said bottle-insertion opening, allowing the insulating cover to be fitted onto said beverage bottle with the neck-fitting portion of the insulating cover fitting the neck portion of said bottle, and with the hollow cylindrical portion of the insulating cover fitting said cylindrical portion of said beverage bottle.

2. The insulating cover for a beverage bottle according to claim 1, in which said cylindrical portion of the insulating cover and said neck portion of the insulating cover both having a permanently continuous perimeter.

3. The insulating cover for a beverage bottle according to claim 1, having first and second seams, each extending from said second end of the neck portion of the insulating cover to said second end of the cylindrical portion of the insulating cover, said first and second seams being on diametrically opposite sides of the insulating cover.

4. The insulating cover for a beverage bottle according to claim 1, having first and second seams, each extending from said second end of the neck portion of the insulating cover to said second end of the cylindrical portion of the insulating cover, said first and second seams being on diametrically opposite sides of the insulating cover, and each of said first and second seams being composed of stitches passing through overlapping portions of said flexible sheet on the interior of the insulating cover.

5. The insulating cover for a beverage bottle according to claim 1, in which said web portion meets said first part of said second end of said cylindrical portion of the insulating cover at a first location, and meets said second part of the second end of said cylindrical portion of the insulating cover at a second location, and in which the width of said web portion, measured in a plane to which said central axis is perpendicular, increases proceeding from each of said first and second locations toward an intermediate location between said first and second locations.

* * * * *